United States Patent [19]

Husbands

[11] 3,938,806

[45] Feb. 17, 1976

[54] NET AND PORTABLE NET ROLLER

[76] Inventor: Kelly Husbands, 600 Urbano, San Francisco, Calif. 94127

[22] Filed: Dec. 11, 1974

[21] Appl. No.: 531,584

[52] U.S. Cl. ..... 273/95 R; 273/29 B; 242/74

[51] Int. Cl.[2] ..... A63B 71/00

[58] Field of Search ..... 273/95 R, 95 H, 29 BB, 273/30, 29 BD; 242/74, 62, 61

[56] References Cited

UNITED STATES PATENTS

| | | | |
|---|---|---|---|
| 1,076,920 | 10/1913 | Sprecher | 242/74 |
| 1,080,229 | 12/1913 | Nelson | 242/74 |
| 1,327,072 | 1/1920 | Thorward | 273/29 BB |

FOREIGN PATENTS OR APPLICATIONS

| | | | |
|---|---|---|---|
| 526,785 | 9/1940 | United Kingdom | 273/29 BB |

*Primary Examiner*—Anton O. Oechsle
*Assistant Examiner*—Marvin Siskind
*Attorney, Agent, or Firm*—Townsend and Townsend

[57] ABSTRACT

A net roller for putting up and taking down game nets such as a volley ball net is disclosed. The net is provided with hooks fixed to the upper and lower margins of the net at each end for attachment of the net to spaced support members. The net roller comprises a cylinder having a length slightly greater than the width of the net, half rings fixed to each end of the cylinder, and a pair of handles rotatably mounted to the ends of the cylinder. The net roller can be used to take down the net by detaching the hooks at one end of the net from one support member and reattaching them to the half rings on the cylinder, rolling the net onto the cylinder, and then detaching the hooks at the other end of the net from the other support member. The net can thereafter be put up by connecting the hooks at the free end of the net to one of the support members, grasping the handles on the net roller while moving toward the remaining support member so that the net unrolls from the cylinder, and then connecting the remaining end of the net to the other support member.

4 Claims, 6 Drawing Figures

NET AND PORTABLE NET ROLLER

BACKGROUND OF THE INVENTION

The present invention relates to game equipment, and in particular to an apparatus and method for putting up and taking down game nets such as a volley ball net.

Most elementary and secondary schools offer a physical education period for students as one of their class periods for the day. The physical education period ordinarily starts out with a few minutes of calisthenics, and then the students are then formed into teams to play various games. The physical education period is ordinarily held in the gymnasium, and various groups of students have their gymnasium period at different times of the day. Since space must often be provided for calisthenics, and different games are often played by different groups of students throughout the day, any equipment required to play the games must ordinarily be put up and taken down several times each day. A substantial portion of the physical education period is thus wasted by changing the game equipment, such as putting up and taking down volley ball nets, tennis nets, and the like. As a result, the game session is ordinarily quite short and the student is given relatively little exercise, often defeating the purpose of the physical education period to significant extent.

SUMMARY OF THE INVENTION

The present invention provides apparatus for putting up and taking down nets such as volley ball nets, tennis nets and so forth. The net is provided with connector elements of a first type fixed to the upper and lower margins of the net at each end for attachment of the net to spaced support members. The apparatus of the present invention comprises a cylinder having a length slightly greater than the width of the net, at least one connector element of a second type complementary to the connector elements of the first type connected to each end of the cylinder, and a pair of handles rotatably mounted to the ends of the cylinder.

The apparatus of the present invention can be used to take down a net by detaching the connector elements at one end of the net from one support member and reattaching the detached connector elements to the complementary connector elements on the cylinder, rolling the net onto the cylinder, and then detaching the connector elements at the other end of the net from the other support member. The net can subsequently be put up by connecting the connector elements at the free end of the net to one or the other of the support members, grasping the handles while moving toward the remaining support member to allow the net to unroll from the cylinder, and connecting the connector elements at the remaining end of the net to the other support member.

The primary advantage of the present invention is that games nets can be put up and taken down in a fraction of the time formerly required. As a result, the game portion of the physical education period can be expanded, and as a result, the students will receive increased exercise. After the net has been taken down, it can conveniently be stored on the apparatus of the present invention until it is again needed.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
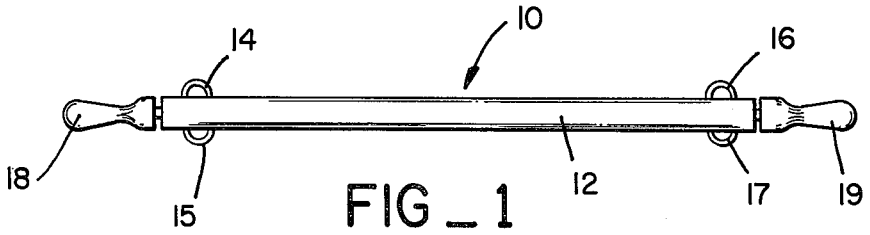
FIG. 1 is an elevation view of the net roller of the present invention.

The net roller 10 of the present invention is illustrated by way of reference to FIG. 1. Net roller 10 includes a cylinder 12 having a length which exceeds the width of the net to be rolled thereon. Pairs of half rings 14, 15 and 16, 17 are disposed at the opposite ends of cylinder 12. The individual half rings such as 14, 15 of each pair are disposed on opposite sides of cylinder 12. A pair of handles 18, 19 are rotatably mounted to the opposite ends of cylinder 12.

Figure 2:
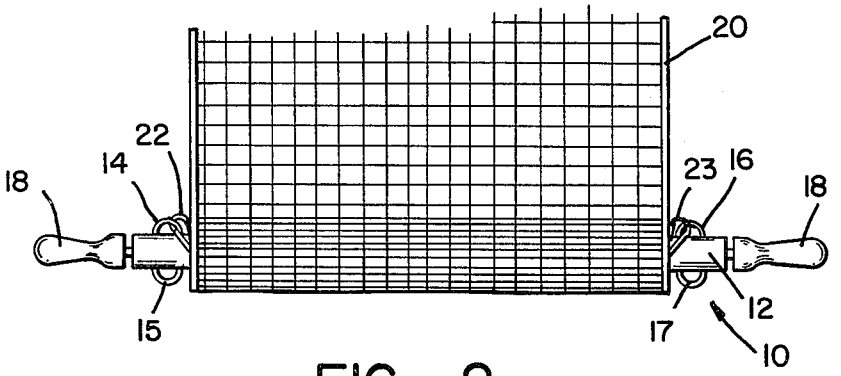
FIG. 2 is a plan view illustrating a net partially wound on the net roller of the present invention.

Referring next to FIG. 2, a net 20 such as a volley ball net, tennis net and so forth having snap hooks 22, 23 fixed to the upper and lower margins of the net is shown partially wound on net roller 10. Snap hooks 22, 23 are engaged with one half ring 14, 16 of each pair, and the net is shown partially rolled onto cylinder 12 of net roller 10. As is evident from FIG. 2, the distance between the pairs of half rings 14, 15 and 16, 17 is slightly greater than the width of net 20 so that the net can easily be rolled onto cylinder 12.

Figure 3:
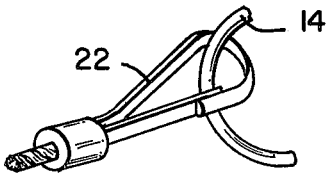
FIG. 3 is an expanded view of the connector elements of the present invention.

In the preferred embodiment of the present invention, the net is provided with snap hooks as illustrated in the enlarged view of FIG. 3. The snap hook 22 can easily be engaged with the half rings such as 14 or any similar loop type structure. However, it is apparent that various types of connector elements can be fixed to the net for engagement with complementary connector elements on cylinder 12. While such snap hooks and half rings are illustrated herein, it is to be expressly understood that the present invention is not limited to these particular types of connector elements.

Figure 4:
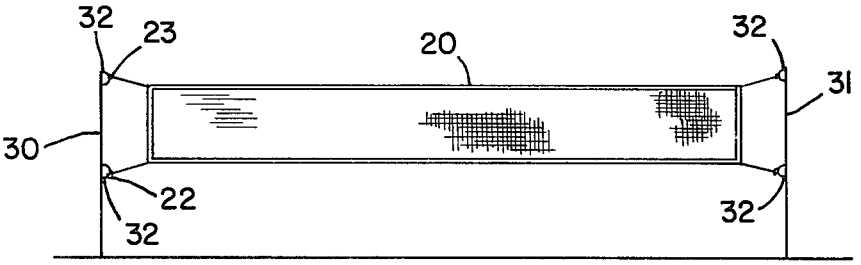
FIG. 4 is an elevation view of a mounted volley ball net.

Referring next to FIG. 4, net 20 is illustrated mounted to two spaced support members 30, 31. Each support member 30, 31 is provided with vertically spaced half rings 32 or similar loop structures. Net 20 is mounted to support members 30, 31 by engaging the snap hooks such as 22, 23 to the various half rings 32.

Figure 5:
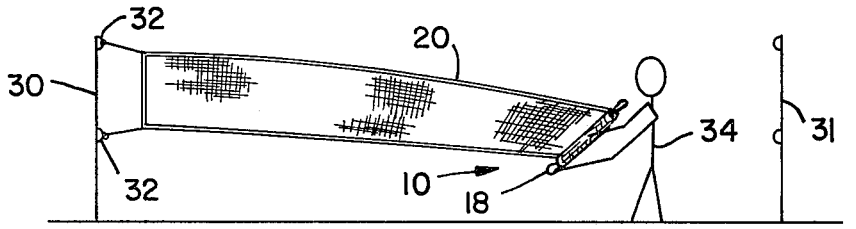
FIG. 5 illustrates the volley ball net of FIG. 4 being taken down using the net roller of the present invention.

When net 20 is to be taken down as illustrated in FIG. 5, the snap hooks connected to one support member such as 31 are disconnected therefrom and attached to half rings on opposite ends of net roller 10. The operator 34 of the net roller can then roll the net onto the roller by holding one of the handles 18 in one hand and rolling the net onto the roller with either an overhand or an underhand motion. Once the entire net 20 has been rolled onto net roller 10, the snap hooks connected to the other support member 30 can be disconnected therefrom and reconnected to the half rings on the opposite ends of the net roller. The net 20 can conveniently be stored on the net roller until again needed.

Figure 6:
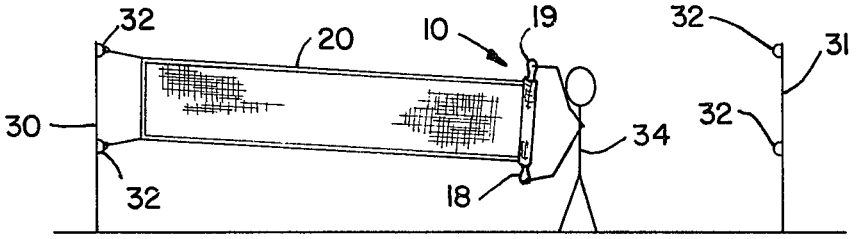
FIG. 6 illustrates the volley ball net of FIG. 4 being put up using the net roller of the present invention.

The net 20 stored on net roller 10 can easily be put up when needed as illustrated in FIG. 6. The snap hooks at the free end of net 20 are attached to complementary half rings 32 on support member 30. The operator 34 then grasps the handles 18, 19 of net roller 10 in each hand and backs toward the other support member 31, allowing the net to unroll from the roller. When the operator 34 reaches support member 31, the snap hooks at the free end of the net can be disconnected from net roller 10 and reconnected to half rings 32 on that support member.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What I claim as new is:

1. Apparatus for putting up and taking down game nets such as volley ball net comprising a net having connector elements of a first type fixed to the upper and lower margins of the net at each end for attachment of the net to spaced support members, a portable cylinder having a length at least as great as the width of said game net, at least one connector element of a second type complementary to the connector elements of the first type fixed to each end of the cylinder, and a pair of handles rotatably mounted to the ends of the cylinder, so that the net can be taken down by detaching the connector elements of the first type at one end of the net from one support member and reattaching the detached connector elements to the respective connector elements on the cylinder, rolling the net onto the cylinder while holding the cylinder by one of the handles, and then detaching the connector elements at the other end of the net from the other support member, and the net thereafter can be put up by connecting the connector elements at the other end of the net to one or the other of the support members, grasping the handles while moving toward the remaining support member to allow the net to unroll from the cylinder, and connecting the connector elements at said one end of the net to the other support member.

2. Apparatus as recited in claim 1 wherein the connector elements of the first type each comprise a snap hook, and wherein the connector elements of the second type each comprise a half ring.

3. Apparatus as recited in claim 2 wherein a pair of half rings are provided at each end of the cylinder, the half rings of each pair being on opposite sides of cylinder.

4. Apparatus for providing a net structure for a volley ball game or similar activity wherein the net structure is to be frequently put up and taken down, said apparatus comprising:

a net having a pair of hooks at each end fixed to the respective upper and lower margins of the net;

a portable cylinder having at least one loop structure at each end, the width of the cylinder between the loop structures being no less than the width of the net;

a pair of handles rotatably mounted to the respective ends of the cylinder; and a net support including two spaced apart support members each having a vertically spaced pair of loops for mounting of the net to the support structure with the hooks, so that the net can be taken down by detaching the hooks at one end of the net from one support member, attaching the hooks to the loop structures on the cylinder, rolling the net onto the cylinder while holding the cylinder by one of the handles and detaching the hooks at the other end of the net from the other support member, and wherein the net can subsequently be put up by reattaching the hooks at said other end of the net to the other support member, grasping the handles and allowing the net to unroll from the cylinder while moving toward the first support member, and detaching the hooks at said one end of the net from the loops structures on the cylinder and reattaching the hooks to said one support member.

* * * * *